US005859618A

United States Patent [19]

Miller, II et al.

[11] Patent Number: 5,859,618

[45] Date of Patent: Jan. 12, 1999

[54] COMPOSITE ROOFTOP ANTENNA FOR TERRESTRIAL AND SATELLITE RECEPTION

[75] Inventors: Robert Raymond Miller, II, Morris Township, Morris County; Jesse Eugene Russell, Piscataway; Robert Edward Schroeder, Morris Township, Morris County, all of N.J.

[73] Assignee: AT&T Corp, Middletown, N.J.

[21] Appl. No.: 770,351

[22] Filed: Dec. 20, 1996

[51] Int. Cl.[6] ..... H01Q 21/00

[52] U.S. Cl. ..... 343/725; 343/720; 343/753; 343/754; 343/755

[58] Field of Search ..... 343/725, 720, 343/755, 753, 754, 781 R, 893, 799, 729, 778; H01Q 15/23, 1/00, 19/10, 21/00

[56] References Cited

U.S. PATENT DOCUMENTS

| | | | |
|---|---|---|---|
| 4,827,276 | 5/1989 | Fukuzawa et al. | 343/778 |
| 5,317,327 | 5/1994 | Piole . | |
| 5,483,663 | 1/1996 | Tawil . | |

*Primary Examiner*—Hoanganh Le
*Assistant Examiner*—Hoang Nguyen
*Attorney, Agent, or Firm*—Alfred G. Steinmetz

[57] ABSTRACT

An antenna structure includes a plurality of vertical directed antennas mounted on an insulated cylindrical substrate. A parabolic reflecting antenna is mounted at one end of the cylindrical substrate cavity and a dielectric lens admits radiation through the cylindrical cavity to the parabolic reflector. Optical detectors are located on the cylindrical substrate periphery and exposed to optical signals through an InfraRed (IR) optical filter.

11 Claims, 2 Drawing Sheets

COMPOSITE ROOFTOP ANTENNA FOR TERRESTRIAL AND SATELLITE RECEPTION

FIELD OF THE INVENTION

This invention relates to an antenna construction and in particular to an antenna for providing radiation and reception for both terrestrial and satellite communications.

BACKGROUND OF THE INVENTION

Radio signals now are the basis of a plurality of services provided to customer premises equipment. These radio signals vary in frequency and modulation and range from typical RF (e,g., FM and AM) and TV signals to TDMA (Time Division Multiple Access), CDMA (Code Division Multiple Access) and MDMA (Multimedia Division Multiple Access) signals used in both mobile and fixed wireless telephony. These various signals are each optimized within a particular band of frequencies. Each particular type signal works best with a particular antenna arrangement and design. Since many customer premises receive a multiplicity of services, the particular customer premises begins to resemble an antenna farm with the number of various antennas required for providing optimal coverage of each service.

SUMMARY OF THE INVENTION

An antenna structure in accord with the invention includes a plurality of vertical directed antennas mounted on an insulated cylindrical substrate. A parabolic reflecting antenna is mounted at one end of the cylindrical substrate and a dielectric lens admits radiation through the cylindrical substrate's longitudinal cavity to the parabolic reflector at the base termination of the longitudinal cavity. Optical detectors are located on the surface periphery of the cylindrical substrate and are exposed to optical signals through an InfraRed (IR) optical filter shielding the cylindrical substrate.

In a particular antenna construction a plurality of vertical directed dipole antennas, with discrete traps disposed along the antenna length, are mounted on a dielectric surface comprised of a cylindrical substrate of thin sheet mylar material with the cylindrical axis directed so as to allow the vertical antennas in parallel therewith to optimally receive terrestrial source radio signals. Each vertical antenna includes a plurality of switchable tuned traps, disposed along its length, each of which may be selectively tuned or disabled as a means of tuning the vertical antenna. Each vertical dipole antenna on the cylindrical substrate is spaced from others on the surface to effect a de-correlation so that an orthogonal spatially perceived image for each vertical antenna is unique.

A circular side structural and filter member is structured from an IR filter material that admits IR signals into the antenna interior. These signals are imaged on optical detector modules deposited on the cylindrical substrate.

DETAILED DESCRIPTION

Figure 1:
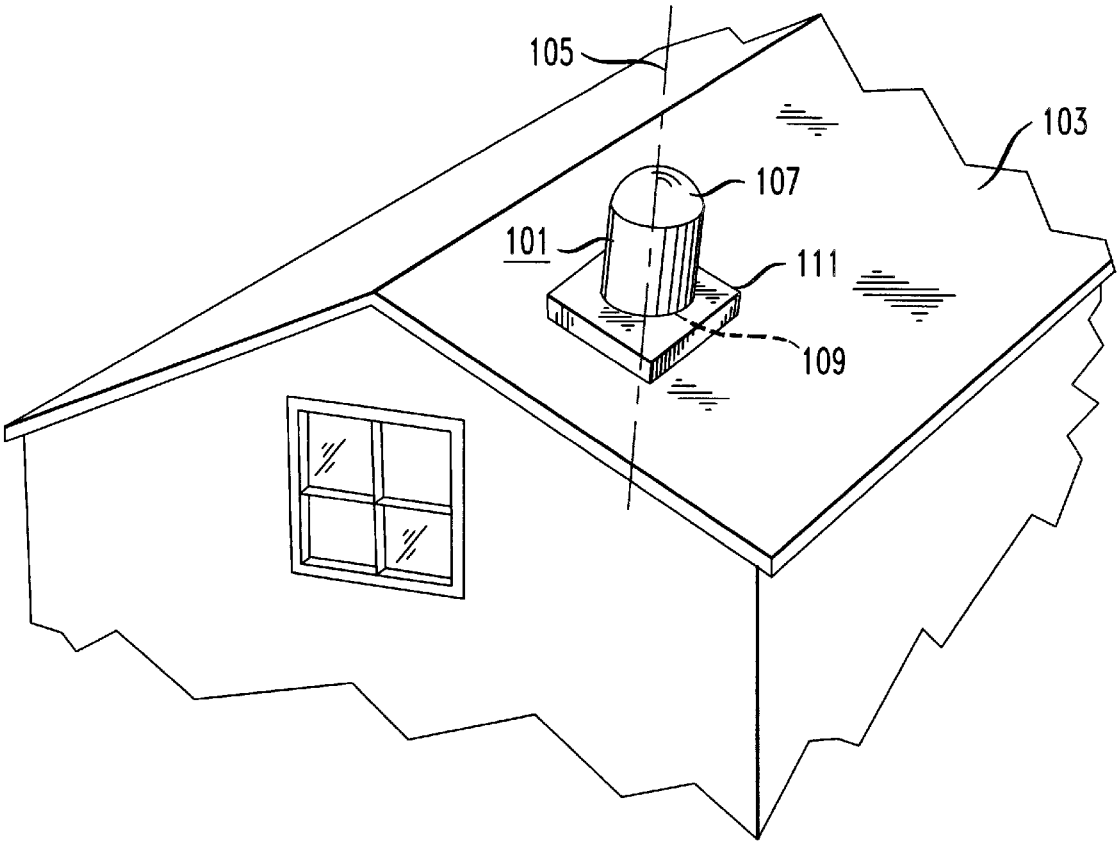
FIG. 1 is a schematic of an antenna mounted on a customer premises roof.

The antenna 101 shown in the FIG. 1 is mounted on a customer premises'roof 103 so that the axis 105 of the antenna structure is mainly oriented in a vertical position. The top of the antenna structure includes a microwave or dielectric lens 107. Opposite the lens at the base of the structure is a parabolic reflector 109 used in signal reception and transmission. The parabolic reflector antenna 109 is positioned at the bottom of the cylindrical substrate. Dielectric lens 107 has focal lens properties and is located at the the top of the cylindrical substrate focuses radio signals from a satellite source onto the reflector antenna 109. Supporting the structure is a supporting mount structure 111 which may include RF processing circuitry for the antenna structure.

Figure 2:
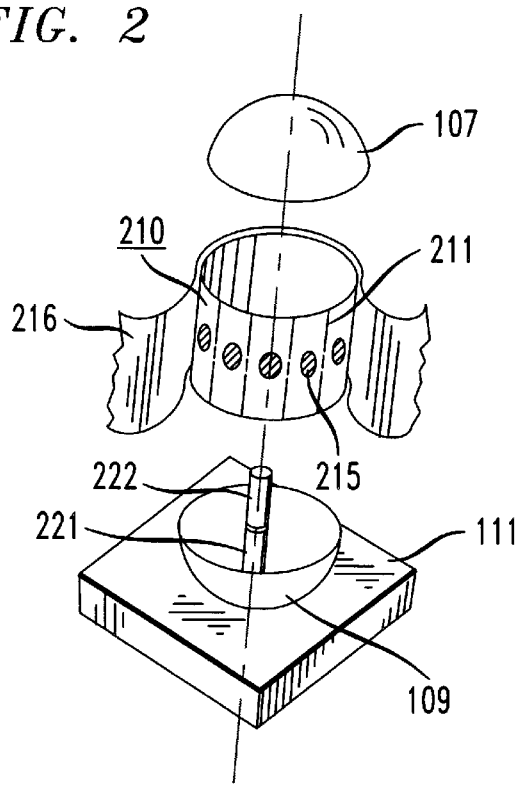
FIG. 2 is a exploded schematic of the antenna structure of FIG. 1.

The antenna structure is shown in an exploded perspective in FIG. 2. A cylindrical insulating substrate 210 has a plurality of dipole antennas 211 printed thereon at regular angular displacements from one another. Located between the printed antennas are optical detectors 215 which in the illustrative embodiment are sensitive to IR radiation which is transmitted by the IR filter material 216 surrounding the detectors 215.

Included within the insulating substrate are source/detector feed units 221 and 222. Unit 222 is for $K_a$ band reception and transmission through the dielectric lens 107 which is designed to focus $K_a$ band transmissions. Unit 221 is designed to handle $K_u$ band transmissions and receive and transmit signals via the parabolic reflector.

Figure 3:
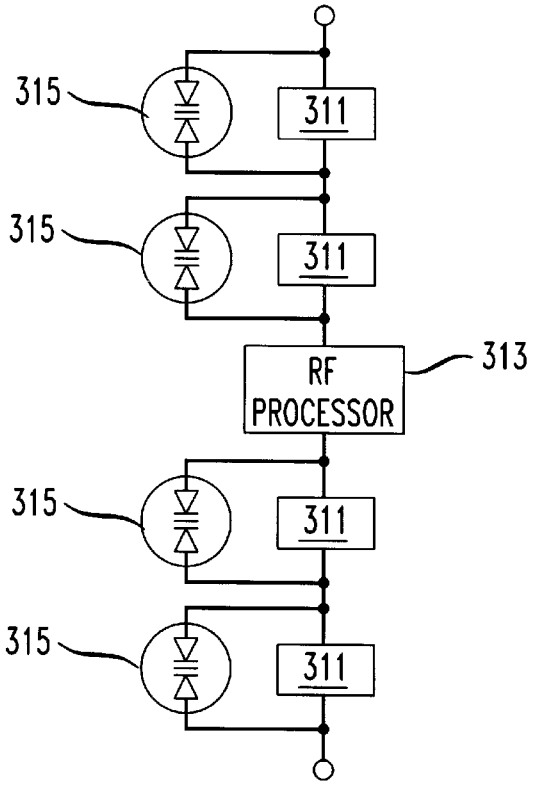
FIG. 3 is a schematic of the antenna dipoles distributed around the perimeter of the antenna structure.

A typical dipole antenna, which may be mounted on the insulating substrate, is shown schematically in FIG. 3. As shown the antenna includes a plurality of switchable traps 311 (e.g., blocking filters) with RF processor 313 located at the antenna center as is the case with a dipole structure. The traps are preferably controllably switchable with a semi conductor switch 315 so that the antenna length may be electrically altered and tuned to various signal frequencies as operation demands. Application of such switches is well known and need not be discussed in detail.

The invention claimed is:

1. A composite antenna for simultaneously providing radiation and reception for both terrestrial and satellite communications, comprising:

a cylindrical insulating substrate having a substantially vertical longitudinal axis supporting a plurality of vertically directed dipole antennas mounted around a surface of the cylindrical substrate and oriented parallel to the vertical longitudinal axis;

a parabolic reflector antenna member mounted at one end of the cylindrical substrate such that the parabolic axis and the parabolic vertex is coincident with the vertical longitudinal axis;

a dielectric lens mounted at another end of the cylindrical substrate opposite the one end of the cylindrical substrate and having its focal axis coincident with the vertical longitudinal axis; and a signal feed located on the vertical longitudinal axis; within the cylindrical insulating substrate and between the parabolic reflector and the dielectric lenses.

2. The antenna of claim 1, further comprising:

each vertically directed dipole antenna including a plurality of switched traps controllable to adjust effective antenna length.

3. The antenna of claim 1, further comprising:

optical detector modules mounted on the cylindrical surface of the cylindrical substrate between the vertically directed antennas; and an infrared filter for blocking visible light surrounding the cylindrical substrate opposite the optical detector modules.

4. The antenna of claim 1, further comprising:

a front end RF processor connected for transmitting RF to and from the vertically directed antenna.

5. The antenna of claim 1, further comprising:

wherein the dielectric lens is effective in radio signal transmittal at microwave frequencies.

6. A composite antenna for responding to and receiving from communicating devices in the sky and on the ground, comprising:

a supporting insulating substrate having a cylindrical shape and having an internal cavity joining two opposing ends;

a plurality of dipole antennas mounted on the cylindrical shape and parallel to a central altitude axis of the cylindrical shape a parabolic reflector antenna at one end of the substrate and a focusing device at the opposing end of the substrate; and source detector/feed unit, interacting with the parabolic reflector antenna, within the cavity for signal communicating with both in the sky and on the ground communicating devices.

7. A composite antenna as claimed in claim 6, further including:

an RF processing module connected to structurally support the composite antenna.

8. A composite antenna for responding to and receiving communicating devices in the sky and on the ground, comprising:

a supporting insulating substrate having an internal cavity joining two opposing ends;

a plurality of dipole antennas mounted on an external structure of the supporting insulating structure;

a parabolic reflector antenna at one end of the substrate and a focusing device, having a dielectric lens, and located at the opposing end of the substrate; and a source/detector feed unit interacting with the parabolic antenna within the cavity for signal communicating with both in the sky and on the ground communicating devices.

9. A composite antenna for responding to and receiving communicating devices in the sky and on the ground, comprising:

a supporting insulating substrate having a cylindrical shape and an internal cavity joining two opposing ends, with a parabolic reflector antenna and a focusing device located at opposite ends of the cylindrical shape;

a plurality of dipole antennas mounted on an external structure of the supporting insulating structure;

the parabolic reflector antenna at one end of the substrate and a focusing device at the opposing end of the substrate; and a source/detector feed unit, interacting with the parabolic antenna, within the cavity unit, for signal communicating with both in the sky and on the ground.

10. A composite antenna for responding to and receiving communicating devices in the sky and on the ground, comprising:

a supporting insulating substrate having an internal cavity joining two opposing ends;

a plurality of dipole antennas mounted on an external structure of the supporting insulating structure;

the dipole antennas each having a plurality of controllably switched traps distributed along its length;

a parabolic reflector antenna at one end of the substrate and a focusing device at the opposing end of the substrate;

a source/detector feed unit, interacting with the parabolic antenna, within the cavity for signal communicating with both in the sky and on the ground communicating devices.

11. A composite antenna for responding to and receiving communicating devices in the sky and on the ground, comprising:

a supporting insulating substrate having an internal cavity joining two opposing ends;

a plurality of dipole antennas mounted on an external structure of the supporting insulating structure;

optical detectors mounted between the dipole antennas;

a parabolic reflector antenna at one end of the substrate and a focusing device at the opposing end of the substrate; and a source/detector feed unit, interacting with the parabolic antenna, within the cavity for signal communicating with both in the sky and on the ground communicating devices.

* * * * *